United States Patent [19]

Sweeny

[11] Patent Number: 5,021,123

[45] Date of Patent: Jun. 4, 1991

[54] PROCESS FOR PRODUCING PAPER FROM A POLY(PARAPHENYLENE TEREPHTHALAMIDE) FIBROUS GEL

[75] Inventor: Wilfred Sweeny, Wilmington, Del.

[73] Assignee: E. I. Du Pont de Nemours and Company, Wilmington, Del.

[21] Appl. No.: 524,734

[22] Filed: May 17, 1990

Related U.S. Application Data

[62] Division of Ser. No. 332,792, Apr. 3, 1989, Pat. No. 4,959,453.

[51] Int. Cl.[5] ..... D21H 13/26

[52] U.S. Cl. ..... 162/157.3; 162/146

[58] Field of Search ..... 162/146, 157.3

[56] References Cited

U.S. PATENT DOCUMENTS

| | | | |
|---|---|---|---|
| 2,999,788 | 9/1961 | Morgan | 162/146 |
| 3,063,966 | 11/1962 | Kwolek et al. | 528/204 |
| 3,869,429 | 3/1975 | Blades | 260/78 |
| 4,011,203 | 3/1977 | Konomi et al. | 260/78 R |
| 4,072,664 | 2/1978 | Konomi et al. | 260/78 |
| 4,511,623 | 4/1985 | Yoon et al. | 428/359 |
| 4,579,895 | 4/1986 | Cuidard et al. | 524/104 |
| 4,698,267 | 10/1987 | Tokarsky | 162/146 |

OTHER PUBLICATIONS

U.S. Ser. No. 07/213,741, filed Jun. 30, 1988.

Japanese Patent Application 52-124099, published Oct. 18, 1977.

*Primary Examiner*—Peter Chin

[57] ABSTRACT

A process for producing a fibrous gel composition of poly(paraphenylene terephthalamide) comprising the steps of placing terephthaloyl chloride in reactive contact with paraphenylene diamine in a solution of at least one amide-type polar solvent (e.g. N-methylpyrrolidone), an alkaline earth metal salt and the aliphatic tertiary amine, N-methylpyrrolidine or its hydrochloride. Poly(paraphenylene terephthalamide) papers are prepared by diluting the composition in an amide diluent, blending in a slurry of poly(paraphenylene terephthalamide) fibers in a precipitating medium, filtering, washing, pressing and drying the mixture.

6 Claims, No Drawings

PROCESS FOR PRODUCING PAPER FROM A POLY(PARAPHENYLENE TEREPHTHALAMIDE) FIBROUS GEL

This is a division of application Ser. No. 07/332,792, filed Apr. 3, 1989, now U.S. Pat. No. 4,959,453.

BACKGROUND OF THE INVENTION

1. Field of the Invention

This invention relates to a process for preparing a poly(paraphenylene terephthalamide) fibrous gel composition comprising an amide solvent, an alkaline earth metal salt and N-methylpyrrolidine or its hydrochloride and a process to prepare wholly poly(paraphenylene terephthalamide) papers using the composition as a binder.

2. Description of the Prior Art

The preparation of poly(paraphenylene terephthalamide) such as taught by U.S. Pat. No. 3,869,429 issued to Blades is generally described by reacting terephthaloyl chloride with para-phenylenediamine in a stirred solution of an alkaline earth metal salt and an amide solvent such as N-methylpyrrolidone. The result is a dry, crumb-like product devoid of fiber structure and too coarse for fiber or paper uses. To make fibers, the polymer component must be isolated from the reaction product by, for example, washing and drying, then dissolving the polymer in an appropriate solvent such as sulfuric acid and spinning the solution through an air gap into a coagulation bath.

Poly(paraphenylene terephthalamide) pulp is generally prepared from such spun filaments which are washed and dried before mechanical abrasion into pulp. It is also generally necessary to use specialized fiber cutting equipment to cut the spun continuous filaments into uniform short lengths before abrasion into pulp.

Obtaining poly(paraphenylene terephthalamide) polymers useful as a pulp directly from the polymerization system without first spinning a fiber is disclosed in U.S. application Ser. No. 07/213,741 filed Jun. 30, 1988. Briefly, that process for producing para-aramid pulp includes forming an actively polymerizing solution containing para-aramid polymer chains by contacting an aromatic diacid halide and an aromatic diamine in a solvent and subjecting the solution to orienting flow. When the solution has a viscosity sufficient to maintain the orientation of the polymer chains, the solution is incubated until it gels. The gel is cut and the pulp is isolated from the gel.

The use of an acid acceptor in a polymerization system is known. As examples, U.S. Pat. Nos. 4,011,203 issued Mar. 8, 1977 and 4,072,664 issued on Feb. 7, 1978 disclose processes to prepare copolymers of two aromatic polyamides optionally using an acid acceptor as a polymerizing additive. Suitable acid acceptors for polymerizing the aromatic polyamides produced from one of piperazine, p-phenylene diamine, terephthaloyl halide or N,N'-bis(p-aminobenzoyl) ethylene diamine may include N-methylpyrrolidine and N-methylmorpholine present in an amount of not more than 10% by volume based on the volume of the solvent in the polymerization system.

Aromatic tertiary amines, such as pyridine are disclosed in references teaching the preparation of aromatic polyamides. For example, Japanese Patent Application 52-124099 published Oct. 18, 1977 discloses a method of preparing aromatic polyamides using as polymerizing additives only aromatic tertiary amines. U.S. Pat. No. 4,511,623 issued Apr. 16, 1985 discloses poly(-paraphenylene terephthalamide) short fibers directly prepared during polymerization of the components of the polymer. Only heterocyclic aromatic tertiary amines such as pyridine, are taught as suitable additives to achieve the desired chain growth. Similarly, U.S. Pat. No. 4,579,895 issued Apr. 1, 1986 to Cuidard, et al. discloses a process to prepare poly(paraphenylene terephthalamide) using tertiary amines with a pKa equal to, at most, 6.60 such as pyridine. Cuidard et al. discloses that the use of an amine with a higher pKa forms a sparingly soluble complex between the tertiary amine and the terephthaloyl chloride, totally or partially preventing the terephthaloyl chloride from reacting with the para-phenylenediamine.

SUMMARY OF THE INVENTION

There is provided by this invention, a process for preparing a poly(paraphenylene terephthalamide) fibrous gel composition comprising the steps of placing substantially stoichiometric amounts of terephthaloyl chloride in reactive contact with para-phenylenediamine in a solution, under agitation, of: (a) at least one amide solvent, preferably N-methylpyrrolidone, in an amount sufficient to produce a final concentration of poly(paraphenylene terephthalamide) in the range from about 3 to about 7 percent by weight of the solvent; (b) at least 1.5 moles of an alkaline earth metal salt per mole of para-phenylenediamine, preferably calcium chloride; (c) and N-methylpyrrolidine present in the range from 1.0 to 2.0 moles per mole of para-phenylenediamine and preferably 1.5 to 1.8 moles per mole of para-phenylenediamine or N-methylpyrrolidine hydrochloride present in the range from 1.5 to 4.0 moles per mole of para-phenylenediamine.

Papers of wholly poly(paraphenylene terephthalamide) are produced by combining, under agitation to yield a slurry, the poly(paraphenylene terephthalamide) fibrous gel composition of this invention; poly(paraphenylene terephthalamide) fiber; and a liquid precipitating medium. The slurry is poured onto a screen to form a sheet, which is washed, pressed and dried.

Surprisingly, it has now been found, by the process of this invention, that the addition of the aliphatic heterocyclic tertiary amine, N-methylpyrrolidine (pKa 10.46) or its hydrochloride to the polymerizing mixture of para-phenylenediamine and terephthaloyl chloride results in a poly(paraphenylene terephthalamide) fibrous gel composition useful in the preparation of poly(-paraphenylene terephthalamide) fiber, pulp and binder fiber.

DETAILED DESCRIPTION OF THE INVENTION

In accordance with this invention, the poly(paraphenylene terephthalamide) fibrous gel composition is prepared by placing substantially stoichiometric amounts of terephthaloyl chloride in reactive contact with paraphenylenediamine in a solution under agitation of at least one amide solvent, an alkaline earth metal salt and N-methylpyrrolidine or N-methylpyrrolidine hydrochloride.

Quantities of terephthaloyl chloride and paraphenylenediamine are employed which result in a final concentration of poly(paraphenylene terephthalamide) in the range from about 3 to about 7% by weight of the amide solvent. Polymer concentrations in excess of 11% by weight of the amide solvent result in the formation of a dry crumb-like product without the fibrous structure necessary for pulp-type uses.

The para-phenylenediamine and the terephthaloyl chloride are reacted in an amide solvent system similar to that disclosed in Kwolek, et al., U.S. Pat. No. 3,063,966. The disclosures of U.S. Pat. No. 3,063,966 is hereby incorporated by reference. Suitable amide solvents, or mixtures of such solvents, include N-methylpyrrolidone, tetramethylurea, N,N-dimethylacetamide. In the preferred form of this invention, N-methylpyrrolidone is the amide solvent.

The presence of at least 1.5 moles of an anhydrous alkaline earth metal salt per mole of para-phenylenediamine in the polymerization system is critical for the preparation of the fibrous gel composition of this invention. Salts which can be used include calcium chloride, lithium chloride and the like. Calcium chloride is conveniently the preferred salt. Without the salt, only a low molecular weight crumb-like product is produced.

In accordance with the invention, the aliphatic heterocyclic tertiary amine, N-methylpyrrolidine or N-methylpyrrolidine hydrochloride, is added to the polymerization mixture of N-methylpyrrolidone, alkaline earth metal salt and para-phenylenediamine and results in the formation of the poly(paraphenylene terephthalamide) fibrous gel composition of this invention on the addition of the terephthaloyl chloride. The N-methylpyrrolidine must be present in the range from 1.0 to 2.0 moles per mole of para-phenylenediamine to achieve the desired fibrous gel composition. The preferred amount of N-methylpyrrolidine is 1.5 to 1.8 moles per mole of para-phenylenediamine. The N-methylpyrrolidine hydrochloride may be used in place of the N-methylpyrrolidine to yield the fibrous gel composition of this invention. N-methylpyrrolidine hydrochloride can be added in the range from 1.5 to 4.0 moles per mole of para-phenylenediamine. Amounts of N-methylpyrrolidine or its hydrochloride added to the system below 1.0, or 1.5 if the hydrochloride is used, yield a reaction product that is crumb-like and similar to the reaction product made in the absence of N-methylpyrrolidine. Amounts of N-methylpyrrolidine added to the system beyond 2.0 moles per mole of para-phenylenediamine limits the molecular weight of the polymer and results in a product with limited utility.

The typical fibrous gel composition of this invention contains fibers of poly(paraphenylene terephthalamide) with lengths in the range of 20 to 500 microns. The inherent viscosity of the polymer isolated from the composition is about 4 to about 6, or higher. The composition is gel-like and non-pourable. When stored as long as two years, the polymer inherent viscosity remains in the same range as the inherent viscosity of freshly isolated polymer. In addition, the composition shows substantially no change on storage for periods up to 2 years, shows no tendency to become brittle or to crumb and retains its utility as a source of fiber, pulp or binder fiber.

Once the fibrous gel composition is obtained, the fibers contained therein can be isolated by further dispersing the composition by dilution in a vigorously stirred precipitating medium comprising a non-solvent for the polymer. The precipitating medium is conveniently water, but can include a variety of polar liquids such as alcohols, amines, amides, N-methylpyrrolidone and mixtures thereof. The fibers produced by the process in accordance with the invention are short fibrillated pulp fibers of poly(paraphenylene terephthalamide). The length of the fibers isolated from the composition of this invention are about 400 to 1000 microns. Since the method does not involve spinning from a sulfuric acid solution, the fibers are free of sulfonic acid groups. The fibers that are isolated from the gel-like composition of this invention can be employed in typical poly(paraphenylene terephthalamide) pulp-type end-use applications such as friction products and gaskets.

The fibrous gel composition can also be used directly as a binder in paper. A wholly poly(paraphenylene terephthalamide) paper can be conveniently prepared by diluting the composition with an amide solvent, preferably N-methylpyrrolidone; and then mixing the diluted gel composition with a slurry of poly(paraphenylene terephthalamide) fiber in water or another suitable precipitation medium. Suitable poly(paraphenylene terephthalamide) fibers for use with the composition are fibers of 0.25 inch or less, "floc", such as sold by the E. I. Du Pont de Nemours and Co., Wilmington, Del. under the trade designation "Kevlar" T-679. The mixture is then filtered to form a sheet structure which is washed, pressed and dried to form a paper sheet.

Longer fibers have been produced from the fibrous gel composition of this invention by press extruding the composition at 90° C. through a spinneret into a water quench. Fibers of up to 12 inches in length were obtained. Tensile properties were T/E/Mi (gpd/%/gpd)=1.4/8/15 as dried and 1.9/5/43 after heating to 250° C.

In the following Examples, as well as in other passages of this specification, parts and percentages are by weight unless otherwise indicated. The Examples which follow illustrate the invention employing the following test methods:

TEST METHODS

Inherent Viscosity

Inherent viscosity (Iv) is defined by the equation:

$$IV = \ln(\eta rel)/c$$

where c is the concentration (0.5 gram of polymer in 100 ml of solvent) of the polymer solution and $\eta$ rel (relative viscosity) is the ratio between the flow times of the polymer solution and the solvent as measured at 30° C. in a capillary viscometer. The inherent viscosity values reported and specified herein are determined using concentrated sulfuric acid (96% $H_2SO_4$).

Length Measurements

The fiber lengths are measured directly from optical microscopic photographs, corrected for the magnification.

Sheet Measurements

The characteristics referred to herein for the sheet in Example 4 are measured by the following methods. In the description of the methods, ASTM refers to the American Society of Testing Materials and TAPPI refers to the Technical Association of Paper and Pulp Industry.

Burst test is measured by TAPPI-403 and uses a 2×2.5 inch sample. Aluminum foil is used as the burst control.

Tongue tear is measured by ASTM method D 2261 and is based on using a 2.0×2.5 inch sample. A one inch slit is cut lengthwise in each specimen. Nominal gauge length is set at one inch and a crosshead speed of 2.0 inch per minute is used.

Strip tensile strength, modulus strain and toughness are calculated from ASTM D-828 and were run using a 0.5×2 inch gauge length sample.

DESCRIPTION OF THE PREFERRED EMBODIMENTS

EXAMPLE 1

This example describes the preparation of a 6% composition of poly(paraphenylene terephthalamide) by weight of N-methylpyrrolidone solvent with 2.8 moles of calcium chloride per mole of para-phenylenediamine and 1.46 moles of N-methylpyrrolidine per mole of para-phenylenediamine.

A resin kettle equipped with a basket stirrer, a nitrogen inlet, and an outlet to which drying tubes were attached, was flamed under a stream of nitrogen to remove adsorbed moisture. 15.6 (0.14 moles) grams of anhydrous calcium chloride dried at 400° C. was added to 200 grams of dried distilled N-methylpyrrolidone in the dried kettle. The mixture was stirred and heated to approximately 100° C. until the calcium chloride was substantially dissolved. The solution was then cooled with an external ice bath and 5.4 grams (0.05 moles) para-phenylenediamine was added and stirred until dissolved. 6.2 grams (0.073 moles) N-methylpyrrolidine was added and the mixture was stirred for several seconds 10.2 grams(0.05 moles) powdered terephthaloyl chloride was added at once, and rinsed in with 20 cc of N-methylpyrrolidone. Immediately, the mixture was rapidly stirred. The cooling bath was removed after about one minute. The stirring was continued for an hour and a half. The solution changed to a thick fibrous gel composition and remained that way throughout the reaction. A sample of the gel was removed at the end of the reaction, and after diluting 5× times with N-methylpyrrolidone, was examined under a polarizing microscope and showed clumps of fibers and individual fibers about 60 microns in length. A sample of the gel was thoroughly extracted with water in a blender, filtered and then dried yielding a fibrous pulpy material. The inherent viscosity of a 0.5% solution in 98% sulfuric acid at 30° C. was 5.03 dl/g.

EXAMPLE 2

This example was carried out as in Example 1 except that 7.5 g (0.088 mole (1.76 moles per mole of para-phenylenediamine)) of N-methylpyrrolidine was used. A thick fibrous gel composition also resulted. A sample of the gel diluted 5× with N-methylpyrrolidone and examined under a polarizing microscope showed clumps of fibers some of which individually exceeded 500 microns in length. Most of the fibers however were 20–60 microns in length. Inherent viscosity of fibrous pulpy material isolated from the gel composition was 4.4 at 0.5% concentration in 98% sulfuric acid.

EXAMPLE 3

Example 1 was repeated except that the N-methylpyrrolidine was replaced by 24 g of N-methylpyrrolidine hydrochloride (3.9 moles per mole of para-phenylenediamine). Polymerization took place rapidly as evidenced by increase in viscosity. The polymer remained in solution through 30 minutes giving a very viscous golden solution. At 39 minutes the solution became a thick gel that balled up on the stirrer. Polymerization was continued for 1.5 hours. The product was then a thick gel, like that seen in Example 1. Examination under the optical microscope showed the gel to contain an oriented fibrous structure. Dilution of the gel 5× with N-methylpyrrolidone and examination under the optical microscope at 100× magnification revealed a fiber and film structure exceeding 500 microns in length. On aqueous work-up, a very fibrous pulpy material was obtained.

Example A

For a control, Example 1 was repeated except that no N-methylpyrrolidine was added. The polymer solution did not remain as a gel but broke up into a damp sawdust-like crumb after stirring for 13 minutes. Stirring however was continued for a total reaction time of 90 minutes. A sample of the polymer mixture was diluted 5× with N-methylpyrrolidone and examined under a polarizing microscope. This showed the polymer as chunks and not as discrete fibers. Inherent viscosity at 0.5% concentration in 98% sulfuric acid was 4.48.

Example B

As a comparison, Example 1 was repeated except 14.2 g(0.16 moles (3.2 moles per mole of para-phenylenediamine)) N-methylpyrrolidine was used. The resultant product was slightly viscous and when precipitated into water in a blender, a powdery, chunky polymer resulted. The inherent viscosity of the isolated polymer was 0.74.

Example C

As a comparison, Example 1 was repeated except that the N-methylpyrrolidine was replaced with 6.9 g (0.087 moles (1.74 moles per mole of para-phenylenediamine)) of pyridine. A gel structure resulted. A sample of the gel was diluted 5× with N-methylpyrrolidone and on examination under a polarizing microscope showed small clumps of fibers which individually were in the 100 micron range. Polymer inherent viscosity at 0.5% concentration in 98% sulfuric acid was 4.7.

Example D

As a comparison, Example 1 was repeated except that the N-methylpyrrolidine was replaced with 7.6 g (0.075 mole (1.5 moles per mole of para-phenylenediamine)) triethylamine. The product was a soft yellow semi-dry gel that solidified after standing overnight. A sample of the product was diluted 5× with N-methylpyrrolidone and on examination under a polarizing microscope showed discrete tiny particles generally less than 15 microns in length. These particles showed little tendency to agglomerate or entangle, as required for paper or binder uses. The polymer inherent viscosity was 3.4.

Example E

As a comparison, Example 2 was repeated except that the N-methylpyrrolidine was replaced with 8.8 g (0.087 moles (1.74 moles per mole of para-phenylenediamine) N-methylmorpholine. Polymerization was rapid on addition of the acid chloride and a dry crumb formed after about 3 minutes. Polymerization was continued for 90 minutes. The dry crumb was examined under a polarizing microscope after dilution 5× with N-methylpyrrolidone and showed polymer chunks interdispersed with small fibers. The inherent viscosity of the isolated polymer was 6.2.

Example F

As a comparison, Example 1 was repeated except that the polymer solution concentration was increased 2× i.e. 7.8 g calcium chloride and 100 g N-methylpyrrolidone were used instead of 15.6 and 200 g, respectively. A viscous solution formed immediately on addition of the acid chloride and a dry crumb formed after about 1 minute. The final product, after water extraction, was a non-fibrous powder. Inherent viscosity at 0.5% in 98% sulfuric acid was 3.6.

Example G

As a comparison, Example F was repeated except that 200 g of N-methylpyrrolidone was used. The polymer again precipitated as a crumb. The inherent viscosity of the product was 4.48.

EXAMPLE 4

The fibrous gel composition made using N-methylpyrrolidine in the polymerization reaction as described in Example 1 was used as a binder to make a paper with poly(paraphenylene terephthalamide) fibers of 0.25 inch or less (hereinafter "floc") sold by the E. I. du Pont de Nemours and Co., Wilmington, Del. under the trade designation "Kevlar" T-679. 40 g of the gel composition was diluted in a Waring Blendor with 150 cc of N-methylpyrrolidone. This yielded a diluted gel. In a separate vessel, 10 g of 0.25 inch floc was slurried by hand in 500 cc water to get uniform dispersion. This was then added to the diluted gel and stirred rapidly for 5 minutes in the blender and filtered through a 12×12 inch hand sheet mold using 100 mesh screen. The sheet was washed several times with water. The poly(paraphenylene terephthalamide) paper sheet was removed from the screen without breakage and dried at 100° C. under a canvas screen at low pressure. The sheet contained 16%–17% binder fiber from the fibrous gel composition. Measured properties on the sheet were: Burst: 1.38psi/oz/sq.yd.; Tongue Tear: 0.38 g./g./sq. meter,; Strip Tensile strength 0.34 lb/in/oz/sq.yd., Modulus 14.2 lb/in/oz/sq.yd., Strain 4.9%, Toughness 0.0121b/oz/sq.yd. A paper made in the same way from floc without binder had no integrity and negligible useful properties.

I claim:

1. A process for preparing a poly(paralphenylene terephthalamide) paper comprising the steps of:

(a) combining, under agitation to yield a slurry:

(i) a poly(paraphenylene terephthalamide) fibrous gel composition prepared by a process consisting essentially of placing substantially stoichiometric amounts of terephthaloyl chloride in reactive contact with para-phenylenediamine in a solution of at least one amide solvent in an amount sufficient to yield a final concentration of poly(-paraphenylene terephthalamide) in the range from about 3 to about 7 percent by weight of the solvent, at least 1.5 moles of an alkaline earth metal salt per mole of para-phenylenediamine and N-methylpyrrolidine present in the range of from 1.0 to 2.0 moles per mole of para-phenylenediamine;

(ii) poly(paraphenylene terephthalamide) fiber; and (iii) a liquid precipitating medium;

(b) pouring the slurry onto a screen to yield a sheet;

(c) washing the sheet;

(d) pressing the sheet; and (e) drying the sheet.

2. The process of claim 1 wherein the fibrous gel is diluted with an amide solvent before combining with the poly(paraphenylene terephthalamide) fiber and the liquid precipitating medium.

3. The process of claim 2 wherein the amide solvent is N-methylpyrrolidone.

4. A process for preparing a poly(paraphenylene terephthalamide) paper comprising the steps of:

(a) combining, under agitation to yield a slurry:

(i) a poly(paraphenylene terephthalamide) fibrous gel composition prepared by a process consisting essentially of placing substantially stoichiometric amounts of terephthaloyl chloride in reactive contact with para-phenylene diamine in a solution of at least one amide solvent in an amount sufficient to yield a final concentration of poly(-paraphenylene terephthalamide) in the range from about 3 to about 7 percent by weight of the solvent, at least 1.5 moles of an alkaline earth metal salt per mole of para-phenylenediamine and N-methylpyrrolidine hydrochloride present in the range of from 1.5 to 4.0 moles per mole of para-phenylenediamine;

(ii) poly(paraphenylene terephthalamide) fiber; and (iii) a liquid precipitating medium;

(b) pouring the slurry onto a screen to yield a sheet;

(c) washing the sheet;

(d) pressing the sheet; and (e) drying the sheet.

5. The process of claim 4 wherein the fibrous gel is diluted with an amide solvent before combining with the poly(paraphenylene terephthalamide) fiber and the liquid precipitating medium.

6. The process of claim 5 wherein the amide solvent is methylpyrrolidone.

* * * * *